US009697707B2

(12) United States Patent
Smith

(10) Patent No.: US 9,697,707 B2
(45) Date of Patent: Jul. 4, 2017

(54) HIGHLY DIRECTIONAL GLASSBREAK DETECTOR

(75) Inventor: Richard Alan Smith, El Dorado Hills, CA (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 945 days.

(21) Appl. No.: 13/105,026

(22) Filed: May 11, 2011

(65) Prior Publication Data

US 2012/0288102 A1 Nov. 15, 2012

(51) Int. Cl.
*G08B 13/00* (2006.01)
*G08B 13/04* (2006.01)

(52) U.S. Cl.
CPC ..... *G08B 13/04* (2013.01)

(58) Field of Classification Search
USPC ..... 340/426.23, 426.27, 511, 541, 550, 566; 381/56, 71.1, 92
See application file for complete search history.

(56) References Cited

U.S. PATENT DOCUMENTS 4,837,558 A * 6/1989 Abel ..... G08B 13/04 310/324
5,192,931 A * 3/1993 Smith ..... G08B 13/04 340/541
5,471,195 A * 11/1995 Rickman ..... G08B 13/04 340/546
5,510,767 A * 4/1996 Smith ..... G08B 13/04 340/550
5,742,232 A * 4/1998 Kurahashi ..... G08B 13/04 340/541
6,538,570 B1 * 3/2003 Smith ..... G08B 13/04 340/550
7,319,392 B2 * 1/2008 Babich ..... G08B 13/1672 340/384.5
7,388,487 B2 * 6/2008 Smith ..... B60R 25/1009 340/426.27
7,443,289 B2 * 10/2008 Smith ..... G08B 13/1672 340/506
7,680,283 B2 * 3/2010 Eskildsen ..... G08B 13/1672 340/541
7,812,855 B2 * 10/2010 Babich ..... G08B 13/04 340/426.23
8,144,010 B2 * 3/2012 Smith ..... G08B 13/04 340/522
8,319,638 B2 * 11/2012 Smith ..... G08B 13/126 250/342
2003/0037257 A1 * 2/2003 Wang ..... G06F 11/3636 726/22
2005/0102663 A1 * 5/2005 Fujii ..... G06F 8/65 717/174

(Continued)

FOREIGN PATENT DOCUMENTS

AU WO 0239783 A1 * 5/2002 ..... H04R 3/005
JP 09154124 A * 6/1997 ..... H04N 7/18

(Continued)

*Primary Examiner* — Travis Hunnings
(74) *Attorney, Agent, or Firm* — Husch Blackwell LLP

(57) ABSTRACT

A glassbreak detector includes first and second different audio transducers. The first transducer is omnidirectional. The second transducer is highly directional. Control circuitry processes signals from both of the first and second transducers and determines if a glassbreakage profile is present.

16 Claims, 2 Drawing Sheets

(56) References Cited

U.S. PATENT DOCUMENTS

| | | | | |
|---|---|---|---|---|
| 2006/0159027 | A1* | 7/2006 | Owens | H04M 3/2218 370/252 |
| 2007/0008125 | A1* | 1/2007 | Smith | B60R 25/1009 340/566 |
| 2007/0024443 | A1* | 2/2007 | Babich | G08B 13/1672 340/545.2 |
| 2008/0148085 | A1* | 6/2008 | Khodabandehlou | G11C 7/1045 713/400 |
| 2010/0283607 | A1* | 11/2010 | Smith | G08B 13/04 340/541 |
| 2011/0026722 | A1* | 2/2011 | Jing | G10L 21/0208 381/71.1 |

FOREIGN PATENT DOCUMENTS

| | | | | | |
|---|---|---|---|---|---|
| JP | 2005128620 | A | * | 5/2005 | G08B 13/04 |
| JP | 2005202708 | A | * | 7/2005 | G08B 13/04 |
| JP | WO 2009142102 | A1 | * | 11/2009 | G08B 13/04 |
| JP | WO 2010067747 | A1 | * | 6/2010 | B60R 25/1004 |
| WO | WO 0239783 | A1 | * | 5/2002 | |
| WO | WO 2009142102 | A1 | * | 11/2009 | |
| WO | WO 2010067747 | A1 | * | 6/2010 | |

* cited by examiner

HIGHLY DIRECTIONAL GLASSBREAK DETECTOR

FIELD

The application pertains to glassbreak detectors. More particularly, the application pertains to such detectors that include highly directional audio transducers.

BACKGROUND

Glassbreak detectors are commonly used to provide environmental feedback as to the condition of windows in security systems that are intended to monitor a predetermined region. Despite their usefulness, they, at times, have problems with false alarms that occur from displaced locations that are in a different direction than the window being protected. This is because they commonly use a microphone that is omni-directional by design, resulting in the detector being sensitive to sounds occurring from any direction. Although uni-directional microphones are available, they are designed in a manner that makes it difficult to distinguish the direction from which an unidentified sound is originating.

In a known prior art implementation of a glassbreak detector, a time of arrival method is implemented using two omni-directional microphones. The microphones are arranged opposed to one another on the order of 180 degrees. This configuration forms a protected zone and an excluded zone. Signals from the two microphones can be processed to detect sounds of glass breaking from the protected zone.

DETAILED DESCRIPTION

Figure 1:
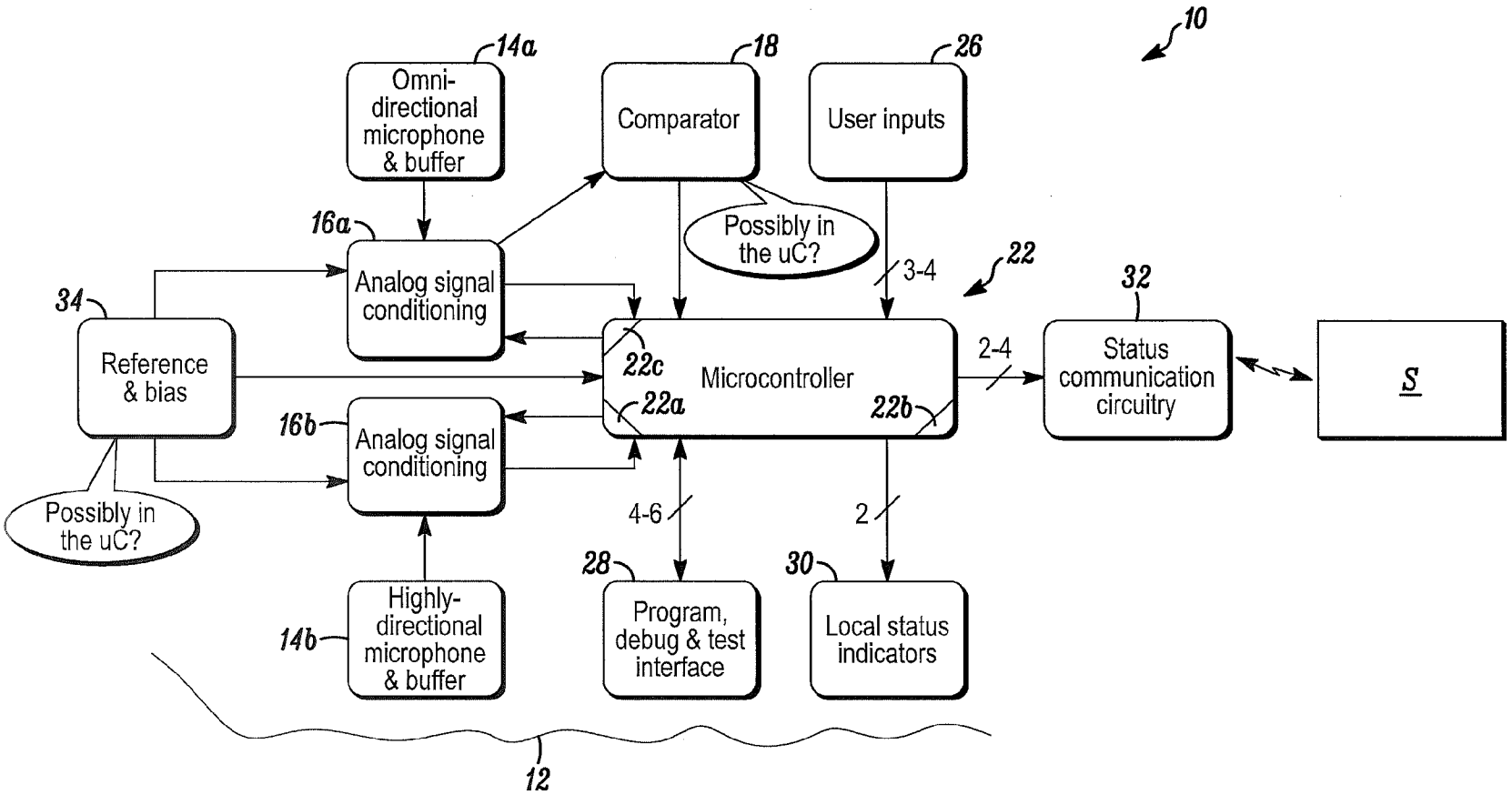
FIG. 1 is a block diagram of a detector that includes a highly directional audio transducer.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

In accordance herewith, a glassbreak detector that is highly sensitive to the direction from which the sound is coming incorporates both an omnidirectional audio transducer, such as an omnidirectional microphone, and a highly directional audio transducer. Additionally, the device can be installed so that it is "aimed" towards the window(s) being protected. As a result, false alarms can be reduced. Another embodiment can be used to identify the location and/or movements of room occupants for high security applications.

In one embodiment, highly directional mems-type acoustical sensors, known as microflowns, could be used in conjunction with an omni-directional microphone. This combination results in a glassbreak detector with reduced susceptibility to false alarms and achieves a high degree of detection when the protected windows are subjected to forced entry. This detector could be installed in a room and "aimed" at the window(s) it is intended to protect and could be programmed to identify the origin direction of sound events to be processed. It could also determine if acoustical characteristics of an event were indicative of a forced entry through the protected window(s) or indicative of a false alarm. An alarm event can be communicated to an alarm panel using known methods.

FIG. 1 is a block diagram of an embodiment of an environmental condition detector 10, for example, a highly directional glassbreak detector, in accordance herewith. The detector 10 has a housing 12 that carries a plurality of electronic components.

The detector 10 includes at least two audio sensors 14*a*, 14*b*. One sensor 14*a* can be implemented, for example, as an omnidirectional microphone and buffer circuits. The second sensor 14*b* can be implemented as a highly directional audio transducer, such as a microflown-type mems sensor. Buffered outputs from the sensors 14*a*, 14*b* can be coupled to analog signal conditioning circuitry 16*a*, 16*b*.

Conditioned analog or digital outputs from one or both circuits 16*a*, 16*b* can be coupled to comparator circuits 18 and/or to control circuits 22. The control circuits 22 can include the comparator circuits 18. The control circuits 22 could be implemented, at least in part, with a programmable processor 22*a* and pre-stored control programs 22*b* stored on non-volatile storage circuits 22*c*.

The control circuits 22 are also coupled to user input circuits 26 that enable a user to specify installation parameters or conditions. A program, debug, and test interface 28, coupled to the control circuits 22, facilitates initial programming, debugging, and testing of the detector 10. The interface 28 can be used after installation to evaluate parameters or other data stored in the non-volatile circuits 22*c*. For example, results of tests or installation of the detector 10 can be stored in the circuits 22*c* for subsequent retrieval and evaluation.

Local status indicators 30, for example, audible or visual indicators, such as audio output devices, LEDs, liquid crystal displays, or the like, are coupled to the circuits 22 and activated thereby to provide local status information. Status communication circuitry 32, coupled to the control circuits 22, provides wired or wireless communication with a displaced regional monitoring system S as would be understood by those of skill in the art.

Figure 2:
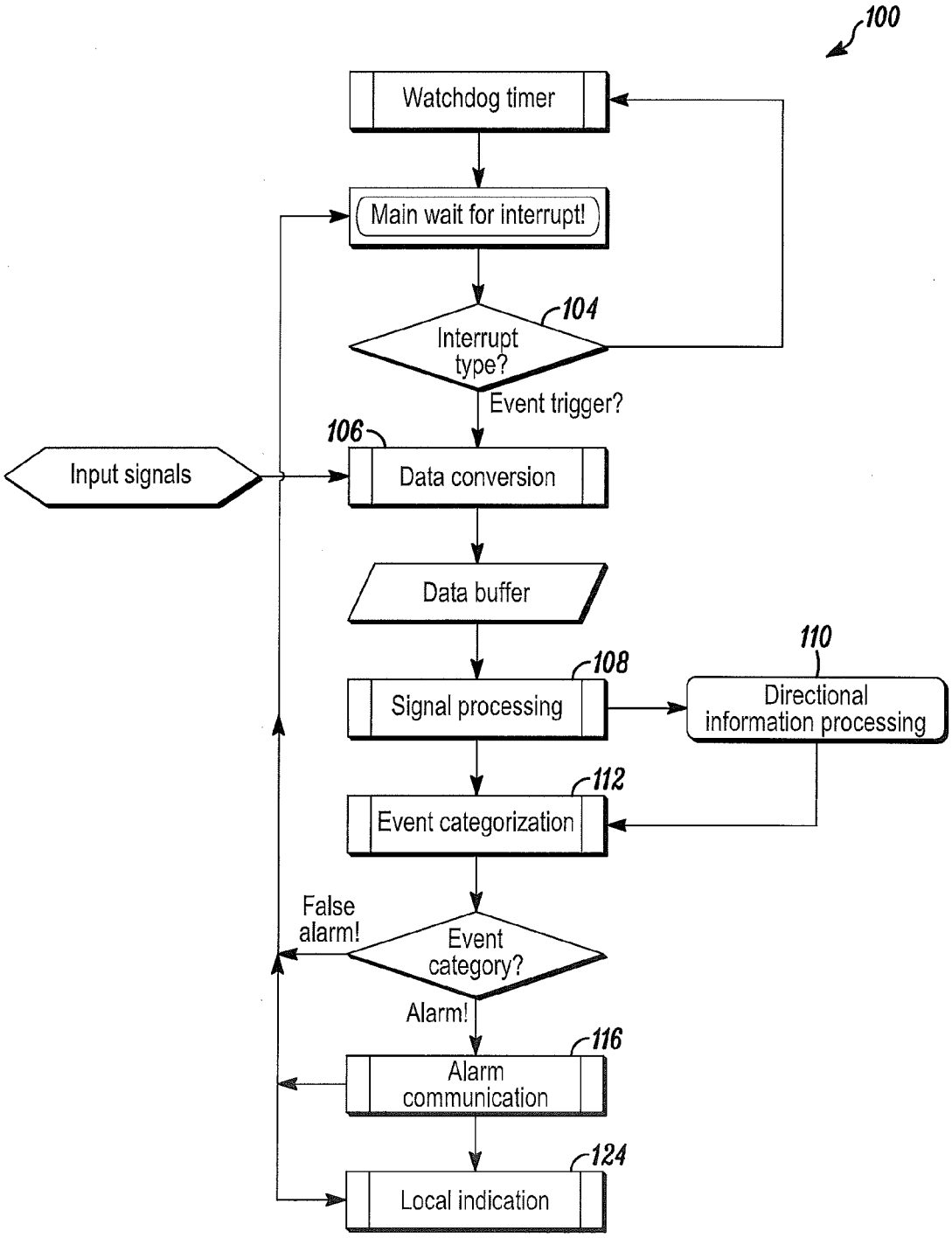
FIG. 2 is a flow diagram illustrating one form of operation of a detector as in FIG. 1.

FIG. 2 illustrates exemplary aspects of processing 100 at the detector 10. In response to detecting an event-indicating interrupt, as at 104, the control circuits 22 can acquire and convert, as at 106, one or more input signal values from the sensors 14*a*, 14*b*. Those signals can be processed, as at 108, including evaluating directional information relative to the transducer 14*b*, as at 110, and categorized as to a type of event, as at 112.

An alarm event can generate an alarm communication, as at 116, either locally, via the output devices 30, or via the communications interface 32. False alarms can advantageously be detected and rejected.

A detected set-up event can be evaluated to determine if installation has been carried out as expected. Installation setup data can be stored in and loaded into the memory 22*c*. A local indication thereof can be provided, as at 124, via the output device(s) 30.

Events can be logged, not shown, and stored in the non-volatile memory 22*c* for after-installation review. Data, for example, one or more operational parameters, installation and setup data, and information relative to logged events, can be retrieved from the memory 22*c* and output via the local interface 28, the local indicators 30, or the communications interface 32.

The pre-stored operational parameters and setup or installation data make possible after-installation reviews to evaluate the operation of the detector 10. Where a detector, such as 10, has failed to perform as expected, such pre-stored information may be the only indicia as to the field condition of the unit. Advantageously, all such data, without limitation, can be detected and stored in real-time and subsequently retrieved.

It will be understood that other types of sensors, including position, thermal, smoke, infra-red, smoke, gas, or flame sensors, can be incorporated into the detector 10 and all come within the spirit and scope hereof. The specific details of microphones, audio transducers, or other types of sensors are not limitations hereof.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. A detector comprising:

a housing;

first and second acoustic transducers carried by the housing, wherein the first acoustic transducer comprises an omnidirectional microphone and the second acoustic transducer has an arcuate sound response that extends over an angle substantially less than one hundred twenty degrees; and control circuits carried by the housing and coupled to the first and second acoustic transducers, wherein the control circuits include processing circuitry to evaluate input signal values from the first acoustic transducer and from the second acoustic transducer to detect if an indicator of a glassbreak has been received and to evaluate the input signal values from only the second acoustic transducer to determine a direction of origin of the input signal values, and wherein the angle of the arcuate sound response of the second acoustic transducer is at least partially pointed in a direction toward a protected object.

2. The detector as in claim 1 further comprising analog or digital conditioning circuits to process signals from the first and second acoustic transducers.

3. The detector as in claim 2 wherein the analog or digital conditioning circuits process the signals, and wherein the control circuits receive the signals as processed and evaluate the signals as processed for a presence of false alarms.

4. The detector as in claim 3 wherein the control circuits evaluate the signals as processed for a presence of at least one glass breakage profile.

5. The detector as in claim 1 wherein the second acoustic transducer is receptive of first sounds from the direction of origin and is less receptive of second sounds from different directions, and wherein the control circuits evaluate differences in conditioned signals from the first and second acoustic transducers.

6. The detector as in claim 5 wherein the control circuits evaluate the conditioned signals for a presence of a glass breakage profile.

7. The detector as in claim 5 wherein the control circuits evaluate the conditioned signals for a presence of false alarms.

8. The detector as in claim 3 further comprising storage circuits for installation and setup data, logged events, or operational parameters.

9. The detector as in claim 8 further comprising interface circuitry coupled to the control circuits and the storage circuits, wherein information in the storage circuits is retrieved.

10. A glassbreak detector comprising:

an omnidirectional audio sensor;

a directional audio sensor with an arcuate sound response that extends over an angle substantially less than one hundred twenty degrees; and control circuits coupled to the omnidirectional and directional audio sensors, wherein the control circuits implement directional information processing to determine a direction of origin of a first input signal value received from the directional audio sensor and a second input signal value received from the omnidirectional audio sensor responsive to only the first input signal value received from the directional audio sensor and to determine if the first input signal value received from the directional audio sensor and the second input signal value received from the omnidirectional audio sensor are indicative of glass breaking, and wherein the directional audio sensor is at least partially pointed in a direction toward a protected object.

11. The glassbreak detector as in claim 10 wherein the control circuits determine if the first and second input signal values are indicative of a false alarm.

12. The glassbreak detector as in claim 10 further comprising storage circuitry coupled to the control circuits, wherein at least one of operational parameters, installation data, or information relative to logged events is stored substantially in real-time and subsequently retrieved.

13. The glassbreak detector as in claim 10 wherein the omnidirectional audio sensor comprises an omnidirectional microphone, and wherein the directional audio sensor comprises a mems-type directional sensor.

14. A method comprising:

sensing first audio omnidirectionally;

sensing second audio from a target direction, wherein the target direction is at least partially pointed in a direction toward a protected object, and wherein a device sensing the second audio from the target direction includes a transducer with an arcuate sound response that extends over an angle substantially less than one hundred twenty degrees;

evaluating only the second audio from the target direction to determine a direction of origin of the first audio sensed omnidirectionally;

combining the first audio sensed omnidirectionally and the second audio from the target direction to establish a composite profile; and evaluating the composite profile to establish a presence of a predetermined condition.

15. The method as in claim 14 further comprising determining if the composite profile is indicative of breaking glass.

16. The method as in claim 14 further comprising determining if the composite profile is indicative of a false alarm.

* * * * *